US005615782A

United States Patent [19]

Choe

[11] Patent Number: 5,615,782

[45] Date of Patent: Apr. 1, 1997

[54] WORK STAND

[76] Inventor: In J. Choe, 5817 McCann Dr., Baton Rouge, La. 70809

[21] Appl. No.: 444,328

[22] Filed: May 18, 1995

[51] Int. Cl.[6] ..... A47F 7/00

[52] U.S. Cl. ..... 211/70.6; 211/60.1; 211/87

[58] Field of Search ..... 211/70.6, 60.1, 211/39, 69, 70.7, 175; 248/117.2, 176.2; 206/372, 373, 349, 320

[56] References Cited

U.S. PATENT DOCUMENTS

| | | | |
|---|---|---|---|
| D. 168,307 | 12/1952 | Lenard | 211/39 X |
| D. 199,321 | 10/1964 | Peterson | 211/70.7 X |
| 712,824 | 11/1902 | Masland | 211/87 |
| 1,392,134 | 9/1921 | Farber | 211/60.1 |
| 3,179,255 | 4/1965 | De'Caccia | 211/70.6 |
| 4,446,972 | 5/1984 | Sussman | 211/60.1 X |
| 4,450,967 | 5/1984 | Castro | 211/60.1 X |
| 5,031,778 | 7/1991 | Edgecombe | 211/13 |
| 5,054,615 | 10/1991 | Stillwagon et al. | 211/70.6 X |
| 5,358,127 | 10/1994 | Ennis | 211/60.1 |
| 5,370,263 | 12/1994 | Brown | 206/373 X |
| 5,485,931 | 1/1996 | Barr, Jr. | 211/70.6 |

FOREIGN PATENT DOCUMENTS

| | | | |
|---|---|---|---|
| 1166793 | 2/1959 | Germany | 211/39 |
| 1595578 | 8/1981 | United Kingdom | 211/70.6 |

*Primary Examiner*—Korie Chan
*Assistant Examiner*—Sandra Snapp
*Attorney, Agent, or Firm*—Keaty & Keaty

[57] ABSTRACT

The invention relates to a work stand for supporting a variety of hair styling instruments in an organized manner. The work stand is formed by a base and a U-shaped supporting plate which is detachably carried by the base. The supporting plate has a plurality of cutouts extending from an outer edge inwardly to retain various hair styling instruments. Cylindrical holders for heated instruments, such as curling irons, are carried by the supporting plate, the cylindrical holders secured within apertures formed in the supporting plate. The supporting plate is provided with a pair of legs which are bent to extend under the bottom of the supporting plate and detachably slidably engage within respective bands secured to the base.

23 Claims, 2 Drawing Sheets

WORK STAND

BACKGROUND OF THE INVENTION

This invention relates to hairdresser's equipment, and more particularly to a stand for supporting combs, hot iron curlers and other similar tools used in hairdressing trade.

Many hairdressers organize their work stations so as to allow easy access to styling instruments, as well as to arrange those instruments in an area designated for a particular stylist in a hair salon. The special area usually is made of a cabinet with a laminated top on which the stylist arranges the instruments. The space designated for a particular stylist is usually limited and maximum attention is paid to organization of styling tools and aids on top of the cabinet. It is also important to take into consideration the fact that the hot curling irons cannot be positioned directly on the laminated surface because the heat can destroy the surface and even cause fire.

A number of tactical solutions have been suggested in the field. For example, U.S. Pat. No. 5,031,778 issued on Jul. 16, 1991 to Edgecombe discloses a support assembly for a hair dryer and a plurality of curling irons which comprises a base supporting plate attached to the base at an angle. An opening in the support plate receives a nozzle portion of a conventional hair dryer, while a plurality of smaller openings receive a plurality of sleeves removably mounted within respective openings. A curling iron is positioned in one of the sleeves in such a manner that a handle of the curling iron extends above the top surface of the supporting plate.

Another example of a hot iron stand is shown in U.S. Pat. No. 5,054,615 issued on Oct. 8, 1991. That stand discloses the use of a base for supporting a heater stove and a vertically oriented band which extends from the supporting plate to support a plurality of cylindrically-shaped receptacles for holding hair irons, such that the cylinders extend above and to the rear of the base. However, this design does not allow supporting of any other styling instruments, for example combs, within the limits of the organizer. Additionally, the rigid band is fixedly attached to the base and cannot be easily separated for transportation.

The present invention contemplates elimination of drawbacks associated with the prior art and provision of improved work stand for organizing a work station of a hair stylist.

SUMMARY OF THE INVENTION

It is, therefore, an object of the present invention to provide a work stand suitable for use in hairdressing salons.

It is another object of the present invention to provide a work station organizer which can be used for supporting a variety of hair styling implements.

It is a further object of the present invention to provide a work stand for a hair stylist which can be assembled and disassembled for easy transportation and storage.

These and other objects of the present invention are achieved through a provision of a work stand which is designed for supporting hair styling instruments within easy access of a hair stylist. The work stand in accordance with the present invention comprises a base and a supporting plate which is oriented at an angle and is detachably engageable with the base. The supporting plate has a generally U-shaped configuration and is provided with a plurality of cutouts extending from an outer edge of the supporting plate inwardly. The cutouts are adapted for retaining various hair styling instruments on the supporting plate in an organized manner.

A plurality of apertures are formed in the body of the supporting plate, each aperture receiving a cylindrical member for retaining a hand-held curling iron or other similar implement. Each cylindrical member has an enlarged flange which rests on a top surface of the supporting plate and prevents the cylindrical member from sliding through the supporting plate. The ends of the U-shaped supporting member are bent to form a pair of hook-shaped legs, at least a portion of which extends under the base and slidably engages with a band which extends below the bottom surface of the base and is fixedly attached thereto.

Extending upwardly from the top surface of the base are a plurality of ridges adapted for supporting a heating source, for example a heat stove, above the base plate. Elongated slots formed adjacent the ridges facilitate dissipation of heat generated by the heat stove and prevent overheating of the base. A box-like enclosure mounted on the base serves as a temporary holder for styling instruments that were removed from the supporting plate for immediate use by a hair stylist.

The work stand in accordance with the present invention advantageously allows to retain a plurality of different styling instruments, such as combs and curling irons in an organized manner within a ready access of the user. The supporting plate which extends a distance above the base retains heated instruments, such as curling irons, away from working cabinets on which the work stand rests.

BRIEF DESCRIPTION OF THE DRAWINGS

Reference will now be made to the drawings, wherein like parts are designated by like numerals, and wherein.

DESCRIPTION OF THE PREFERRED EMBODIMENT

Figure 1:
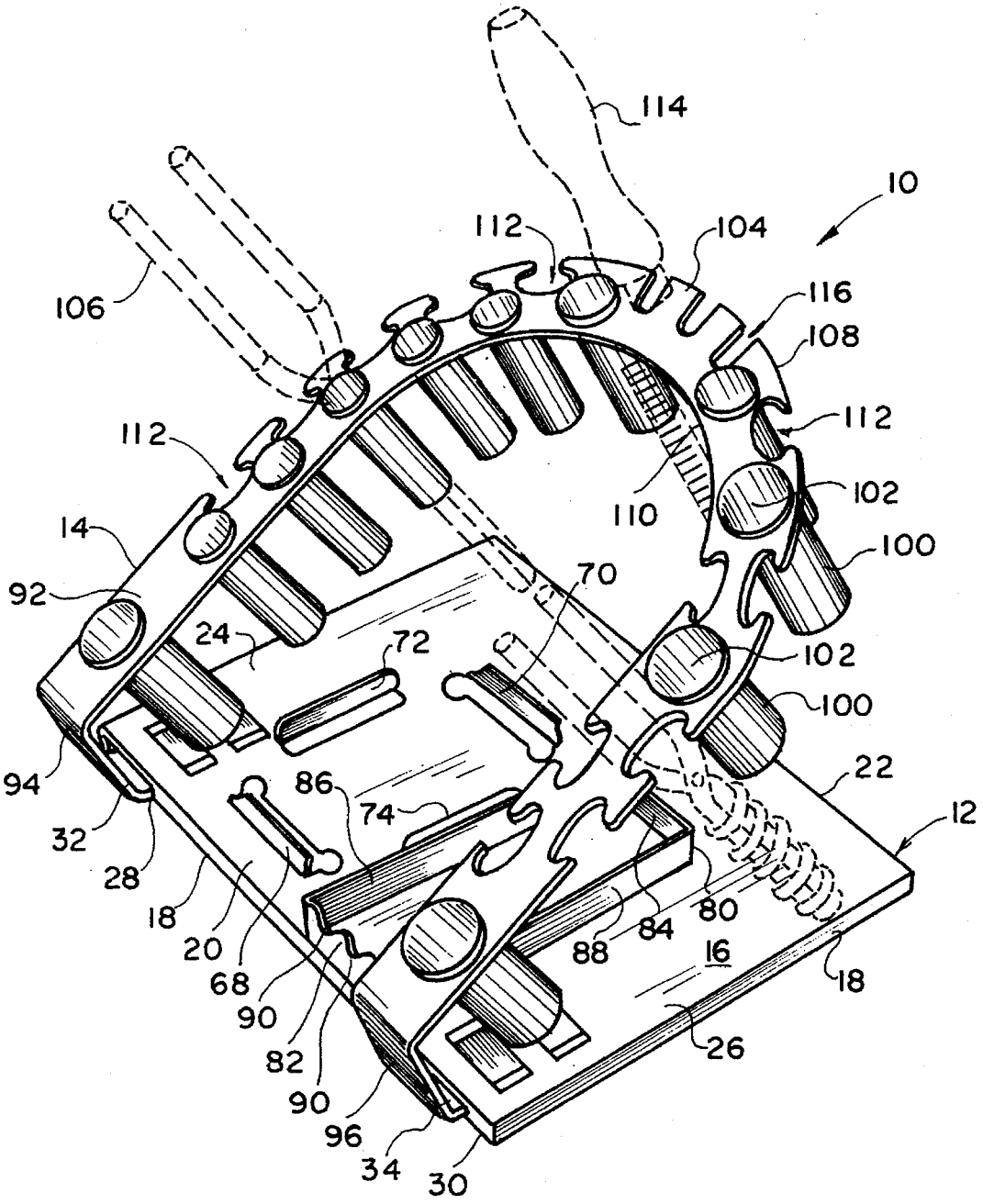
FIG. 1 is a perspective view of a work stand in accordance with the present invention, with hair styling instruments shown in phantom lines.

Turning now to the drawings in more detail, numeral 10 designates a work stand in accordance with the present invention. As can be seen in the drawings, the work stand 10 comprises a base 12 and a U-shaped supporting plate, or member 14. The base 12 comprises a substantially rectangular plate 16 supported by downwardly depending flanges 18 which are adapted to rest on a horizontal surface. Even though not shown in the drawings, it will be appreciated that flanges 18 are fixedly attached to the front side 20, to the rear side 22 and to opposing parallel ends 24 and 26. A pair of cutouts 28 and 30 are formed in the front facing flange 18, with each cutout being sized and shaped to slidably detachably receive engaging ends 32 and 34, respectively, of the supporting member 14.

The plate 16 is provided with a number of elongated apertures to facilitate engagement of the ends 32 and 34 with the base 12. A first set of apertures is designated by numerals 36 and 38 in the drawings and illustrates a pair of elongated slots formed in a substantially parallel relationship to the front side 20 of the plate 16. Each of the slots 36 and 38 is formed by cutting two parallel elongated lines in the surface of the plate 16 and forcing the segment between the two lines downwardly, such that two downwardly extending strips 40 and 42 respectively, are formed below the plate 16. Each strip or band 40 and 42 is retained fixed to the plate 16 by its attachment to the plate 16 through narrow ends 44, 46 and 48, 50, respectively.

A similar pair of slots 52 and 54 is formed on the opposite side of the plate 16, so that the slot 52 is in general alignment with the slot 36, while the slot 54 is in general alignment with the slot 38. As a result, another pair of support member retaining bands 56 and 58, respectively, are formed on the opposite side of the base plate 16 to receive the end 34 of the supporting member 14.

Figure 2:
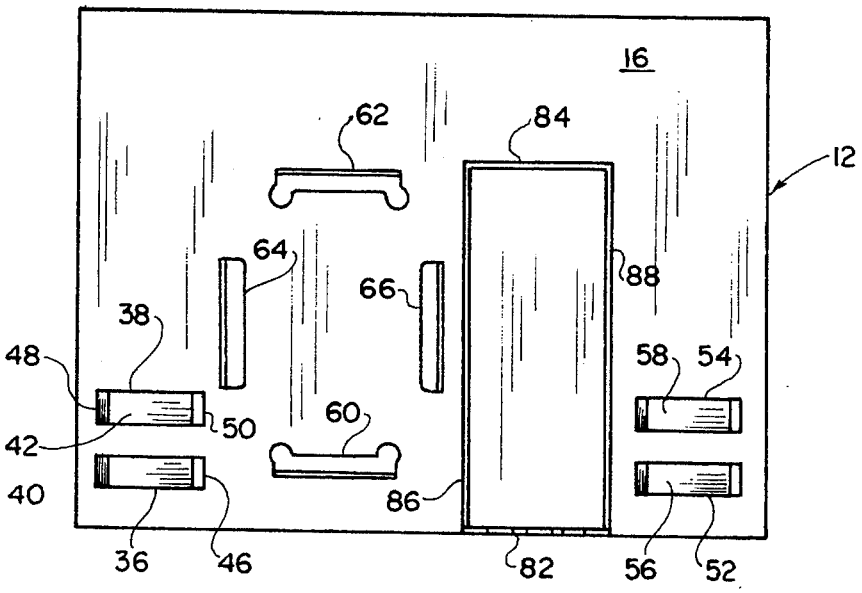
FIG. 2 is a top view of a base plate of the work stand in accordance with the present invention.

As can be better seen in FIGS. 1 and 2, the base plate 16 is further provided with four apertures 60, 62, 64 and 66 generally forming a rectangular shape. The apertures are formed by cutting along three sides of elongated apertures and forcing the cutout segment of the plate 16 upwardly, at approximately a 90 degree angle to form upwardly extending ridges 68, 70, 72 and 74. These ridges are adapted to temporarily retain a heat stove (not shown) above the top surface of the plate 16, within the confines of the work stand 10. The ridges 68, 70, 72 and 74, as well as the apertures 60, 62, 64 and 66, facilitate dissipation of heat generated by a stove positioned on the ridges. As a result, the work surface of a hair dresser's cabinet is not damaged by the generated heat.

A temporary holder 82 for hot iron curlers and other instruments is formed on the plate 16. The holder 80 comprises four vertically extending walls 82, 84, 86 and 88. The wall 82 is greater in height than the wall 84, and the connecting parallel walls 86 and 88 have inclined upper edges extending between the wall 82 and the wall 84. The top edge of the wall 82 is provided with one or more recesses 90, so as to allow temporary positioning of a portion of a curling iron or other styling instrument within the recess 90 in such a manner that a handle of the instrument extends forwardly from the wall 82, while a heated portion of a curling iron faces the back 22 of the base 12.

The holder 80 defines a confined space for temporary retaining hot instruments and preventing the sliding of the tools in either direction outside of the walls 82, 84, 86 and 88. These walls are fixedly attached, such as by soldering or welding, to the plate 16, and the top surface of the plate 16 forms the bottom of the holder 80.

Figure 3:
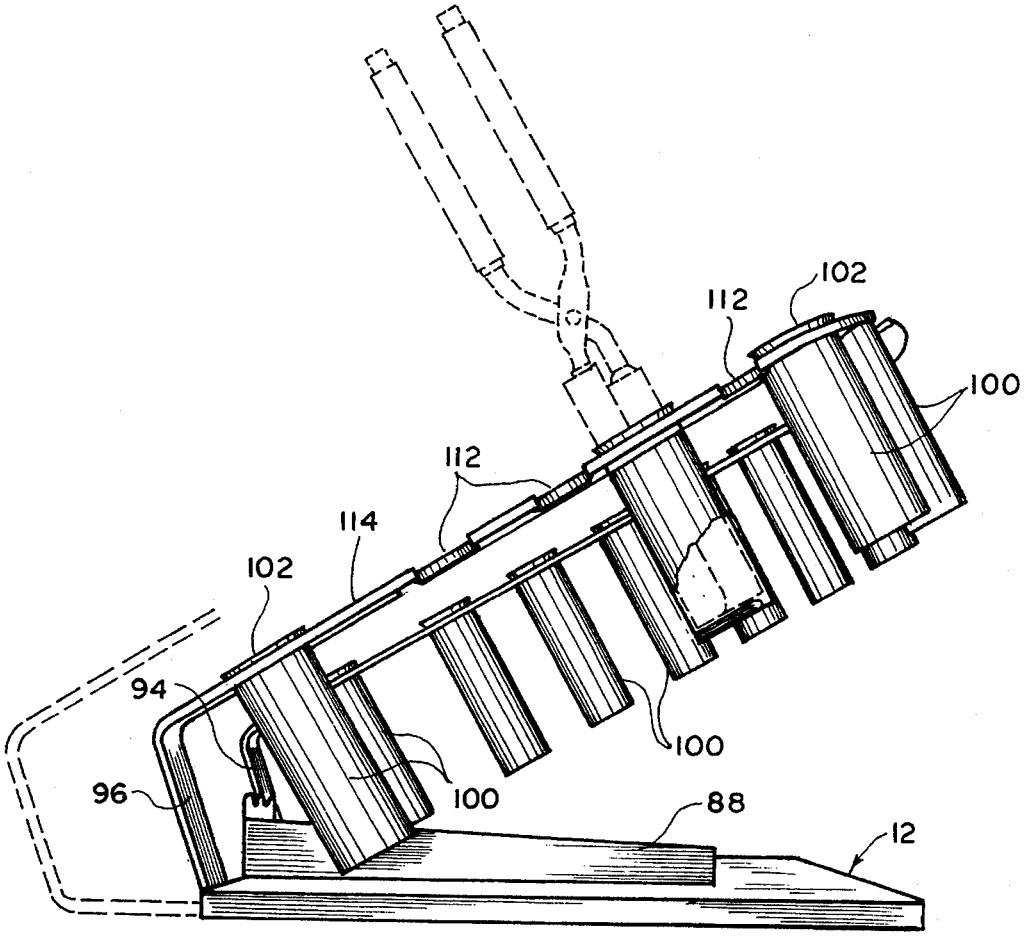
FIG. 3 is a side view of the work stand in accordance with the present invention.

The supporting plate, or member 14, is comprised of a U-shaped plate having a top surface 92, a part of which extends at an acute angle to a generally horizontal surface of the plate 16. The plate 14 is inclined forwardly, to the front 20 of the base 12 and is retained in a detachable relationship to the base 12 through a provision of a pair of downwardly inclined legs 94 and 96. The legs 94 and 96 are bent at a right angle in relationship to the top surface 92 and form the backwardly bent extending ends 32 and 34 which slide into the cutouts 28 and 30, respectively. The movement of the supporting plate is shown in phantom lines in FIG. 3.

A plurality of circular apertures is formed in the support plate 14 in a spaced-apart relationship. Mounted within these apertures are a plurality of cylindrical members 100 each of which is provided with an enlarged diameter flange 102. The flange 102 insures stable engagement of the cylindrical members 100 within the respective apertures. Additionally, the cylindrical members 100 can be secured to the supporting member 14 by welding or soldering, if desired.

As can be better seen in FIG. 1, the cylindrical members 100 have different diameters, with the largest diameter members engaged in an aperture closer to the front of the stand 10, so as to counter-balance upwardly extending portion 104 of the support plate 14.

The cylindrical members 100 do not have a bottom but can be provided with a pin or cross rod (not shown) while extends across the lowermost portion of the member 100, so as to prevent implements positioned in the member 100 from falling out of the stand.

Each cylindrical member 100 is designed to retain a different size curling iron 106 shown in phantom lines in FIG. 1. The iron 106 is positioned in such a manner that its handles extend upwardly from the supporting plate 14, while its heated portion fits within the cylindrical member 100.

The supporting member 14 has an outer edge 108 and an inner edge 110. The edges 108 and 110 are provided with a plurality of irregularly-shaped cutouts 112, which are designed for supporting styling instruments such as styling instruments for example combs 114, shown in phantom lines in FIG. 1. The cutouts can be of different shapes and diameters, for example one or more cutouts 116 can be of an elongated shape extending deeper into the width of the supporting plate 14 than oval-shaped cutouts 112.

As can be seen in the drawings, each of cutouts 112 has an inner part which is greater in size than its outer part, so that the passageway which extends from the outer edge 108 of the plate 14 is smaller than the inner part of the cutout 112. In this manner, stable position of the hair styling instrument 114 within the cutout is assured.

The styling instrument 114 can be only withdrawn by moving its handle upwardly to withdraw a more narrow portion of the styling instrument from the cutout 112. Another possible way of withdrawing a hair styling instrument would be to turn it in such a way that its narrow portion passes through the outer part of the cutout 12.

The size of the cutout 112 and 116 is selected to allow only a portion of the styling instrument to pass therethrough, so that the handle of the styling instrument extends outwardly and upwardly from the surface 92 and allows easy access to the instrument. The cutouts are spaced from each other and from the cylindrical members 100 such that the handles of the styling instruments and curling irons are distanced from each other. As a result, all, or a desired number, of styling instruments can be conveniently organized on the stand 10 without cluttering the working space allotted to an individual stylist.

The material from which the stand 10 is manufactured can differ. For example, greater mass metal can be used for the base 12 and a light weight metal for the supporting plate 14. It is important to position the cylindrical members 100 in such a manner as to prevent overturning of the stand 10 when the heated stove and hot curling irons are used. If desired, the holder 80 can be made detachable from the base 12 and the shape of the base 12 can be easily changed.

Many other changes and modifications can be made in the design of the present invention without departing from the spirit thereof. I, therefore, pray that my rights to the present invention be limited only by the scope of the appended claims.

I claim:

1. A work stand for supporting hair styling instruments, comprising:

a base; and a generally U-shaped supporting plate oriented at an angle to and detachably engageable with said base, said supporting plate being provided with means formed in an outer edge of the supporting plate for retaining said hair styling instruments on said supporting plate, said supporting plate having a top surface and a pair of downwardly inclined legs, each of said legs comprising a first portion oriented at a right angle to said top surface and a second portion unitary connected at an angle to said first portion, and wherein said second portion of each of said legs is slidably engageable within a corresponding slot formed in a front side of the base.

2. The device of claim 1, wherein said retaining means comprises a plurality of spaced cutouts extending a distance inwardly from said outer edge.

3. The device of claim 1, wherein said supporting plate further comprises means for retaining curling irons.

4. The device of claim 3, wherein said means for retaining curling irons comprises a plurality of cylindrical members engageable within apertures formed in said supporting plate.

5. The device of claim 4, wherein an upper part of each of said cylindrical members is provided with an enlarged flange to prevent disengagement of said cylindrical member from said corresponding aperture.

6. The device of claim 1, wherein said base comprises means for detachably supporting a heating source above an upper surface of the base.

7. The device of claim 6, wherein heating source supporting means comprises a plurality of spaced ridges which extend upwardly from said base.

8. A work stand for supporting hair styling instruments, comprising:

a base; and a supporting plate oriented at an angle to and detachably engageable with said base, said supporting plate being provided with means formed in an outer edge of the supporting plate for retaining said hair styling instruments on said supporting plate, wherein said base comprises a means for detachably supporting a heating source above an upper surface of the base, said heating source supporting means comprising a plurality of spaced ridges which extend upwardly from the base, and wherein elongated slots are formed in said base adjacent said ridges to facilitate dissipation of heat generated by said heating source.

9. A work stand for supporting hair styling instruments, comprising:

a base having a bottom surface and a front side; and a supporting plate having a generally U-shaped configuration, said supporting plate being oriented at an angle to and detachably engageable with said base, said supporting plate being provided with a top surface, a pair of downwardly inclined legs, and means formed in an outer edge of the supporting plate for retaining said hair styling instruments on said supporting plate, each of said legs comprising a first portion oriented at a right angle to said top surface and a second portion unitary connected at an angle to said first portion, said second portion of each of said legs being slidably engageable within a corresponding slot formed in the front side of said base, and wherein at least one band is fixedly attached to said base in general alignment with said slot on each side of said base, said at least one band extending at a distance below said bottom surface.

10. The device of claim 9, wherein said second portion of each of said legs is slidably detachably received within said band when said supporting plate is positioned on said base.

11. The device of claim 1, wherein said base comprises means for temporary holding a discrete number of hair styling instruments.

12. The device of claim 11, wherein said holding means comprises a box-like enclosure defined by an upper surface of said base and upwardly extending walls fixedly attached to said upper surface.

13. The device of claim 2, wherein a discrete number of said cutouts have an inner part which is greater in size than an outer part of said cutouts, so as to prevent disengagement of a hair styling instrument positioned within a cutout from said supporting plate.

14. A work stand for supporting hair styling instruments, comprising:

a base having a bottom surface;

at least one band fixedly attached to said base on two opposing sides of said base, said at least one band extending at a distance below said bottom surface of said base; and a supporting plate oriented at an angle to and detachably engageable with said base, said supporting plate being provided with means formed in an outer edge of the said supporting plate for retaining said hair styling instruments on said supporting plate, said retaining means comprising a plurality of spaced cutouts extending a distance inwardly from said outer edge, said supporting plate further comprising means for retaining curling irons a distance above an upper surface of said base, said means for retaining curling irons comprising a plurality of cylindrical members engageable within apertures formed in said supporting plate, and wherein said supporting plate has a generally U-shaped configuration and is provided with a top surface and a pair of downwardly inclined legs, each of said legs comprising a first portion oriented at a right angle to a top surface and a second portion unitary connected at an angle to said first portion.

15. The device of claim 14, wherein said second portion of each of said legs is slidably detachably received through a corresponding slot formed in a front side of said base and within said at least one band when said supporting plate is positioned on said base.

16. The device of claim 14, wherein an upper part of each of said cylindrical members is provided with an enlarged flange to prevent disengagement of said cylindrical member from said corresponding aperture.

17. A work stand for supporting hair styling instruments, comprising:

a base provided with means for detachably supporting a heating source above an upper surface of the base, said supporting means comprising a plurality of spaced ridges which extend upwardly from said base, and wherein at least one elongated slot is formed in said base adjacent said ridges to facilitate dissipation of said heat generated by said heating source; and a supporting plate oriented at an angle to and detachably engageable with said base, said supporting plate being provided with means formed in an upper edge of the supporting plate for retaining said hair styling instruments on said supporting plate, said retaining means comprising a plurality of spaced cutouts extending a distance inwardly from said outer edge, said supporting plate further comprising means for retaining curling irons a distance above an upper surface of said base, said means for retaining curling irons comprising a plurality of cylindrical member engageable within apertures formed in said supporting plate.

18. The device of claim 14, wherein said base comprises means for temporary holding a discrete number of hair styling instruments, said holding means comprising a box-like enclosure defined by an upper surface of said base and outwardly extending walls fixedly attached to said upper surface.

19. A work stand for supporting hair styling instruments, comprising:

a base; and a U-shaped supporting plate oriented at an angle and detachably engageable with said base, said supporting plate being provided with a pair of hook-shaped legs unitary attached at an angle to said U-shaped plate, said supporting plate being provided with a plurality of irregularly-shaped cutouts extending a distance inwardly from an outer edge of said supporting plate, said cutouts being adapted for retaining different hair styling instruments on said supporting plate.

20. The device of claim 19, wherein said supporting plate is further provided with a plurality of apertures, each adapted for retaining a cylindrically shaped member, said cylindrically shaped member being sized and shaped to retain a curling iron therein.

21. The device of claim 19, wherein a band is securely attached to said base, said band being adapted for retaining at least a portion of said leg of the supporting plate.

22. The device of claim 19, wherein said base comprises means for detachably supporting a heating source above an upper surface of the base, said supporting means comprising a plurality of spaced ridges which extend upwardly from said base, said base being formed with a plurality of elongated slots adjacent said ridges to facilitate dissipation of heat generated by said heating source.

23. The device of claim 19, wherein a discrete number of said cutouts has an inner part which is greater in size than an outer part of said cutouts, so as to prevent disengagement of a hair styling instrument positioned within the cutout from said supporting plate.

* * * * *